US009901943B2

(12) United States Patent
Schmalz

(10) Patent No.: US 9,901,943 B2
(45) Date of Patent: Feb. 27, 2018

(54) PRESSURE WASHER GUN WITH CHEMICAL INJECTION AND FOAMING CAPABILITIES

(71) Applicant: Briggs & Stratton Corporation, Wauwatosa, WI (US)

(72) Inventor: Jacob Schmalz, Milwaukee, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 222 days.

(21) Appl. No.: 14/519,750

(22) Filed: Oct. 21, 2014

(65) Prior Publication Data

US 2015/0108253 A1 Apr. 23, 2015

Related U.S. Application Data

(60) Provisional application No. 61/894,532, filed on Oct. 23, 2013.

(51) Int. Cl.

| | |
|---|---|
| ***F23D 11/16*** | (2006.01) |
| ***B05B 7/00*** | (2006.01) |
| ***B05B 7/12*** | (2006.01) |
| ***B05B 7/24*** | (2006.01) |
| ***B05B 7/04*** | (2006.01) |
| ***B08B 3/02*** | (2006.01) |
| ***B01F 5/04*** | (2006.01) |
| *B05B 1/16* | (2006.01) |

(52) U.S. Cl.

CPC ..... *B05B 7/0087* (2013.01); *B01F 5/0428* (2013.01); *B05B 7/005* (2013.01); *B05B 7/0425* (2013.01); *B05B 7/1209* (2013.01); *B05B 7/2437* (2013.01); *B05B 7/2443* (2013.01); *B08B 3/028* (2013.01); *B05B 1/1654* (2013.01)

(58) Field of Classification Search

CPC ..... B05B 7/0087; B05B 7/005; B05B 7/0425; B05B 7/1209; B05B 7/2437; B05B 7/2443; B05B 1/1654; B01F 5/0428; B08B 3/028

USPC ..... 239/419.5

See application file for complete search history.

(56) References Cited

U.S. PATENT DOCUMENTS

| | | | |
|---|---|---|---|
| 2,228,705 | A | 1/1941 | Olson |
| 3,052,417 | A | 9/1962 | Daniel |
| 3,394,888 | A | 7/1968 | Dasse et al. |

(Continued)

OTHER PUBLICATIONS

Yardlover, "New Miracle Gro Liquid Feeder", retrieved from the internet at: https://www.youtube.com/watch?v=MLu6x2fFVDs, uploaded May 9, 2008, 58 seconds.

*Primary Examiner* — Arthur O Hall
*Assistant Examiner* — Adam J Rogers
(74) *Attorney, Agent, or Firm* — Foley & Lardner LLP

(57) ABSTRACT

A pressure washer spray gun includes a spray gun body configured to be fluidly coupled to a source of pressurized water, a chemical container coupled to the spray gun body, wherein the chemical container is configured to contain liquid chemical, a venturi including a converging section, a throat, and a diverging section, wherein the venturi is coupled to the body, and wherein the chemical container is fluidly coupled to the throat, an air inlet port formed in the diverging section and configured to fluidly couple the diverging section to a source of air, and multiple nozzles, wherein each nozzle has a different orifice diameter, and wherein only one nozzle at a time can be selected to provide a fluid output from the spray gun.

20 Claims, 4 Drawing Sheets

(56) References Cited

U.S. PATENT DOCUMENTS

| | | | | | |
|---|---|---|---|---|---|
| 3,784,110 | A | | 1/1974 | Brooks | |
| 3,930,615 | A | * | 1/1976 | Farnsteiner | B05B 7/0081 239/419.5 |
| 4,475,689 | A | * | 10/1984 | Hauger | B05B 7/2443 239/318 |
| 4,795,092 | A | | 1/1989 | Fuller | |
| 4,826,084 | A | | 5/1989 | Wallace | |
| 4,955,540 | A | | 9/1990 | Fuller et al. | |
| 4,991,776 | A | * | 2/1991 | Smith | B05B 7/0081 137/895 |
| 5,064,123 | A | * | 11/1991 | Aiello | A01M 7/0046 239/128 |
| 5,069,397 | A | | 12/1991 | Haslund | |
| 5,242,119 | A | | 9/1993 | Jariyasunant | |
| 5,381,962 | A | | 1/1995 | Teague | |
| 5,467,929 | A | | 11/1995 | Bosio | |
| 5,472,145 | A | | 12/1995 | Shannon et al. | |
| 5,779,099 | A | | 7/1998 | D'Andrade | |
| 6,003,787 | A | | 12/1999 | Fisher | |
| 6,126,089 | A | * | 10/2000 | Williamson | B05B 1/1609 134/100.1 |
| 6,293,294 | B1 | * | 9/2001 | Loeb | B01F 5/0405 137/1 |
| 6,526,803 | B1 | | 3/2003 | Fraenkel et al. | |
| 6,571,805 | B2 | | 6/2003 | Hoenisch et al. | |
| 6,685,107 | B1 | | 2/2004 | Salzman | |
| 6,848,633 | B2 | | 2/2005 | Ryser | |
| 7,051,954 | B2 | | 5/2006 | Gerstner | |
| 7,083,120 | B2 | | 8/2006 | Gilpatrick et al. | |
| 7,159,797 | B1 | * | 1/2007 | Lammers | B05B 15/065 239/390 |
| 7,217,053 | B2 | | 5/2007 | Alexander et al. | |
| 7,389,949 | B2 | | 6/2008 | Marchand et al. | |
| 7,472,842 | B2 | | 1/2009 | Gilpatrick et al. | |
| 2003/0052199 | A1 | | 3/2003 | Ikeuchi et al. | |
| 2005/0284960 | A1 | * | 12/2005 | Arevalo | B05B 1/1636 239/310 |
| 2007/0039570 | A1 | * | 2/2007 | Wilfert | B60S 3/044 122/392 |
| 2007/0125878 | A1 | | 6/2007 | Hahn et al. | |
| 2008/0061167 | A1 | | 3/2008 | Gansebom | |
| 2008/0251603 | A1 | | 10/2008 | Monty | |
| 2009/0050706 | A1 | | 2/2009 | Xu et al. | |
| 2009/0065607 | A1 | * | 3/2009 | Gardner | F16L 37/248 239/127 |
| 2010/0059605 | A1 | * | 3/2010 | Plantz | B01F 5/0413 239/316 |

* cited by examiner

PRESSURE WASHER GUN WITH CHEMICAL INJECTION AND FOAMING CAPABILITIES

CROSS-REFERENCE TO RELATED PATENT APPLICATIONS

This application claims the benefit of U.S. Provisional Application No. 61/894,532, filed Oct. 23, 2013, which is incorporated herein by reference in its entirety.

BACKGROUND OF THE INVENTION

The use of high-pressure spray systems for various cleaning tasks is well-known and prevalent in both residential and commercial settings. These systems use either engine-driven or electric-motor-driven pumps to pressurize the water or cleaning fluid for a more powerful and effective spray. Typically the systems use trigger-actuated spray guns or wands that are manipulated by the user to start and stop the flow of high-pressure water from a nozzle or nozzles at the tip of the gun or wand.

In addition to simply spraying water for cleaning purposes, high-pressure spray systems may also be configured to draw a cleaning chemical into the fluid stream for delivery out of the spray gun. The chemical may be introduced forcibly into the fluid stream (i.e., via a separate pump), or it may be drawn into the fluid stream using a venturi placed in-line with the fluid stream, wherein a liquid chemical is fluidly coupled to the throat of the venturi so as to be drawn into the stream under certain pressures. Utilizing a venturi for chemical injection is often the preferred method given the fact that it requires few added components and few modifications to the existing spray system.

In addition to chemical injection, there is often a desire to introduce air into the combined fluid/chemical stream so as to achieve a foaming spray. One common use for such a foaming spray is for a vehicle wash. There have been a number of devices used to achieve this chemical injection with foaming spray on high-pressure spray systems, but each of these devices requires that a separate spray head/nozzle be connected to the spray gun when the user desires a foaming spray. If the user wishes to only use a chemical/fluid combined spray or a fluid-only spray, they must remove the chemical injection and foaming spray device from the gun and replace it with another appropriate nozzle. Such a change-over is cumbersome and time-consuming.

Accordingly, it would be advantageous to provide a chemical injection and foaming spray system for use with a pressure washer that enables the user to switch between a foaming setting, a combined chemical/fluid setting, and a fluid-only setting without removing any components from the spray gun.

SUMMARY

One embodiment of the invention relates to a pressure washer spray gun including a spray gun body configured to be fluidly coupled to a source of pressurized water, a chemical container coupled to the spray gun body, wherein the chemical container is configured to contain liquid chemical, a venturi including a converging section, a throat, and a diverging section, wherein the venturi is coupled to the body, and wherein the chemical container is fluidly coupled to the throat, an air inlet port formed in the diverging section and configured to fluidly couple the diverging section to a source of air, and multiple nozzles, wherein each nozzle has a different orifice diameter, and wherein only one nozzle at a time can be selected to provide a fluid output from the spray gun.

Another embodiment of the invention relates to a pressure washer spray gun including a spray gun body configured to be fluidly coupled to a source of pressurized primary fluid, a fluid container coupled to the spray gun body, wherein the fluid container is configured to contain a secondary fluid, a venturi including a converging section, a throat, and a diverging section, wherein the venturi is coupled to the body, and wherein the fluid container is fluidly coupled to the throat, an air inlet port formed in the diverging section and configured to fluidly couple the diverging section to a source of air, and multiple nozzles, wherein each nozzle has a different orifice diameter, and wherein only one nozzle at a time can be selected to provide a fluid output from the spray gun.

Another embodiment of the invention relates to a pressure washer spray gun including a spray gun body including an inlet for receiving a pressurized fluid and a valve configured to be manipulated by a user to control discharge of the pressurized fluid, a rotatable end including multiple nozzles, wherein the rotatable end can be rotated by a user, and wherein upon rotation, one of the plurality of nozzles is selected to discharge fluid from the pressure washer spray gun, wherein the plurality of nozzles each have a different sized effective opening, a secondary fluid container coupled to the spray gun body, a venturi provided between the inlet, the rotatable end, and the secondary fluid container, an air inlet. When a first nozzle is selected, only the pressurized fluid flows through the first nozzle. When a second nozzle is selected, the pressurized fluid draws the secondary fluid into the venturi from the secondary fluid container, forming a combined fluid flow for discharge through the second nozzle. When a third nozzle is selected, the pressurized fluid draws the secondary fluid into the venturi from the secondary fluid container, forming a combined fluid flow, and at least one of the pressurized fluid and the combined fluid flow draws air into the venturi through the air inlet, forming a foaming combined fluid flow for discharge through the third nozzle.

Alternative exemplary embodiments relate to other features and combinations of features as may be generally recited in the claims.

BRIEF DESCRIPTION OF THE DRAWINGS

The invention will become more fully understood from the following detailed description, taken in conjunction with the accompanying drawings.

DETAILED DESCRIPTION

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Figure 1:
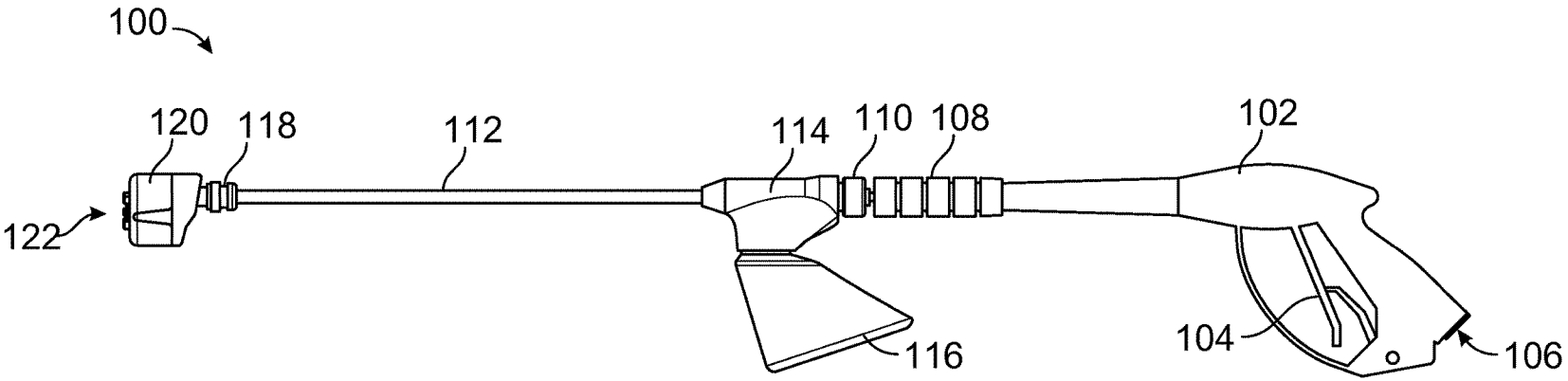
FIG. 1 illustrates a pressure washer gun having a chemical injection and foaming system in accordance with an exemplary embodiment.
Figure 2:
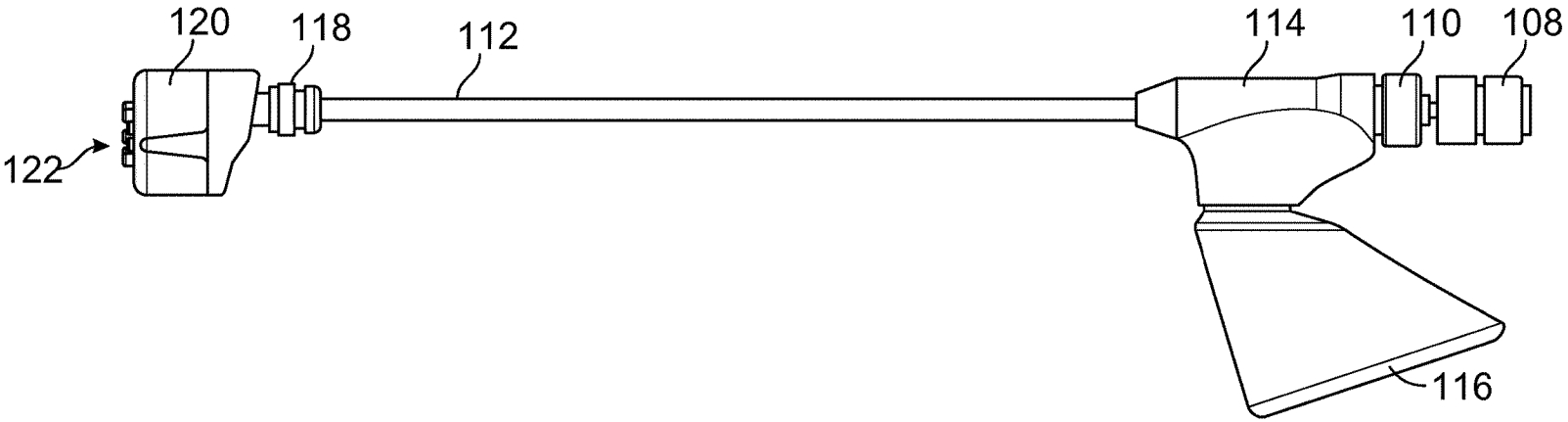
FIG. 2 illustrates a portion of the pressure washer gun of FIG. 1.

Referring to FIG. 1 and FIG. 2, a pressure washer gun 100 in accordance with an exemplary embodiment is shown. Pressure washer gun 100 comprises a body 102 having a trigger 104 attached thereto. Actuation of trigger 104 opens a valve that enables pressurized fluid (e.g., water) from a pump to flow through gun 100. The pressurized fluid is delivered to gun 100 via a fluid inlet 106 that is fluidly coupled to a primary fluid source (e.g., by a hose). Body 102 further comprises a handle 108 that may be grasped by the operator of the pressure washer.

Beyond handle 108 on body 102 is a connector 110. Connector 110 is configured to attach a spray wand 112 to body 102. On spray wand 112 is a chemical injector housing 114 having a chemical bottle or container 116 attached thereto. Alternatively, housing 114 is a component of body 102 or other portion of pressure washer gun 100. In some embodiments, spray wand 112 is omitted. In some embodiments, spray wand 112 is integral with body 102 (i.e., body and spray wand are a single unity structure). Chemical bottle 116 may be attached via any appropriate attachment means, i.e. threading, quarter-turn, etc. At the opposite end of wand 112 is a nozzle connector 118 that couples a turret-style nozzle head 120 to wand 112. Nozzle connector 118 also may be any appropriate attachment means, i.e., threaded, quick-release, etc. Turret-style nozzle head 120 has a plurality of nozzles 122 from which pressurized fluid is ejected after traveling through gun 100. As will be described in further detail below, turret-style nozzle head 120 comprises a plurality of spray nozzles having differing diameters and shapes in order to adjust the pressure and spray pattern of the fluid ejected from gun 120. In the exemplary embodiment, turret-style nozzle head 120 may be rotated clockwise or counterclockwise to enable the user to select a desired nozzle. However, other configurations of nozzle head 120 are also possible. In some embodiments, multiple individually replaceable nozzles are provided in place of the rotatable nozzle head.

Figure 3:
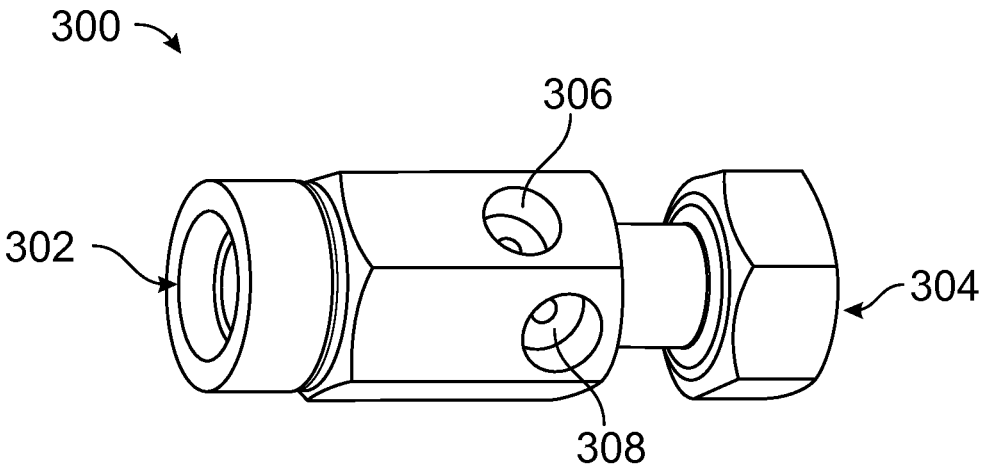
FIG. 3 illustrates a chemical injector fitting for the pressure washer gun of FIG. 1.

Referring now to FIG. 3, a chemical injector fitting 300 in accordance with an exemplary embodiment is shown. Chemical injector fitting 300 is housed within chemical injector housing 114 shown in FIG. 1 and FIG. 2 so as to be in-line with the fluid conduits of body 102 and spray wand 112. Fitting 300 may be formed of brass or any other suitable material capable of withstanding high pressures. Additionally, fitting 300 is shown in FIG. 3 to be partially hexagonal in shape, but could be any appropriate shape (e.g., cylindrical).

Chemical injector fitting 300 comprises an inlet opening 302 and an outlet opening 304. Inlet opening 302 is in fluid communication with a source of primary fluid (e.g., the fluid exiting body 102 of gun 100 from the pressure washer pump), while outlet opening 304 is in fluid communication with wand 112. Fitting 300 further comprises a chemical injection inlet port 306 in fluid communication with a source of secondary fluid (e.g., a container of liquid chemicals) and an air inlet port 308 in fluid communication with a source of air (e.g., the ambient environment around spray gun 100), the operations of which will be further described below with respect to FIG. 4.

Figure 4:
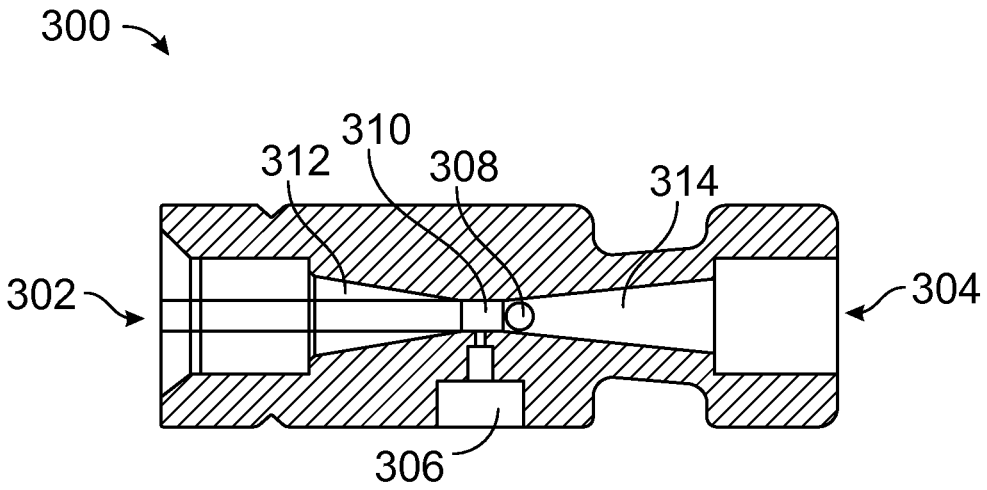
FIG. 4 illustrates a sectional view of the chemical injector fitting of FIG. 4.

FIG. 4 shows a cross-sectional view of chemical injector fitting 300 in accordance with an exemplary embodiment. As described above, pressurized fluid enters inlet opening 302 and eventually exits fitting 300 through outlet opening 304. After entering inlet opening 302, the fluid first travels through a converging section 312, then through a venturi throat 310, and then through a diffuser section 314, before it exits fitting 300 at outlet opening 304. Fluid flowing through converging section 312, venturi throat 310, and diffuser section 314 create a well-known venturi effect, wherein the velocity of the fluid flowing through venturi throat 310 increases compared to the velocity of the fluid flowing through converging section 312, while the static pressure at venturi throat 310 decreases compared to that of converging section 312. When a secondary fluid (e.g., a liquid chemical) is fluidly coupled to fitting 300 at chemical injection inlet port 306, the pressure differential described above enables the secondary fluid to be drawn into the primary fluid stream flowing through venturi throat 310. Chemical injection inlet port 306 is in fluid communication with (fluidly coupled to) chemical container 116 and in fluid communication (fluidly coupled to) venturi throat 310 to provide liquid chemicals stored in chemical container 116 to venturi throat 310. Chemical injection inlet port 306 may include a check valve to restrict flow in one direction (i.e., so that primary fluid does not exit through chemical injection inlet port 306). This configuration allows a secondary fluid to be drawn into the primary fluid stream using fluid dynamics alone, i.e., without the use of pumps or other mechanical intervention. Additionally, chemical bottle 116 could be fluidly coupled to chemical injection inlet port 306 via a variable valve (not shown). This variable valve would allow for the user to manually adjust the injection rate of the secondary fluid that can be drawn into the primary fluid stream.

In accordance with the exemplary embodiment shown in FIG. 4, chemical injector fitting 300 further comprises an air inlet port 308 located slightly downstream of venturi throat 310 (i.e., between venturi throat 310 and outlet opening 304). Air inlet port 308 may include a check valve which restricts flow in one direction (i.e., so that primary fluid and/or secondary fluid do not exit fitting 300 through air inlet port 308). Air inlet 308 is in fluid communication with diffuser section 314 and a source of air (e.g., the ambient environment around fitting 300). As with the venturi effect that draws a secondary fluid into the primary fluid stream flowing through fitting 300, the fluid velocity created in the venturi throat 310 can be utilized in the diffuser section 314 to entrap air when downstream pressures are low, effectively creating an ejector to draw air into the fluid stream via the air inlet port 308. The combination of primary fluid, secondary fluid (e.g., liquid chemical), and air creates a foaming spray that is often desired for certain cleaning or coating applications. Accordingly, chemical injector fitting 300 also serves as an air injector fitting so as to enable foaming sprays to be emitted from spray gun 100.

Figure 5:
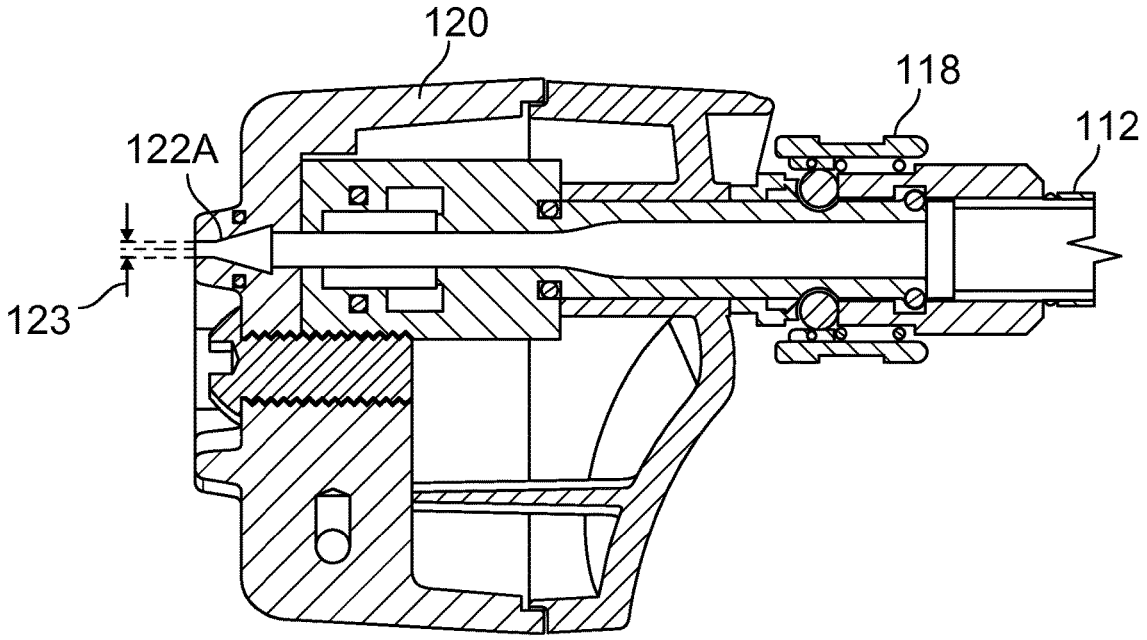
FIG. 5 illustrates a sectional view of a turret nozzle assembly for the pressure washer gun of FIG. 1.
Figure 6:
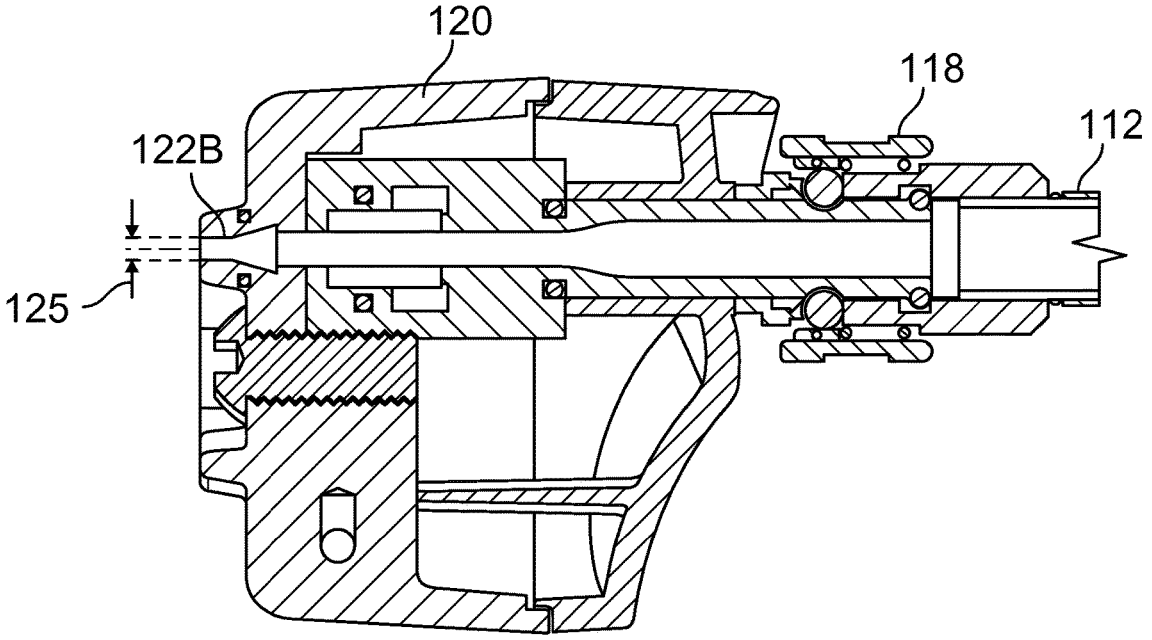
FIG. 6 illustrates another sectional view of a turret nozzle assembly for the pressure washer gun of FIG. 1.
Figure 7:
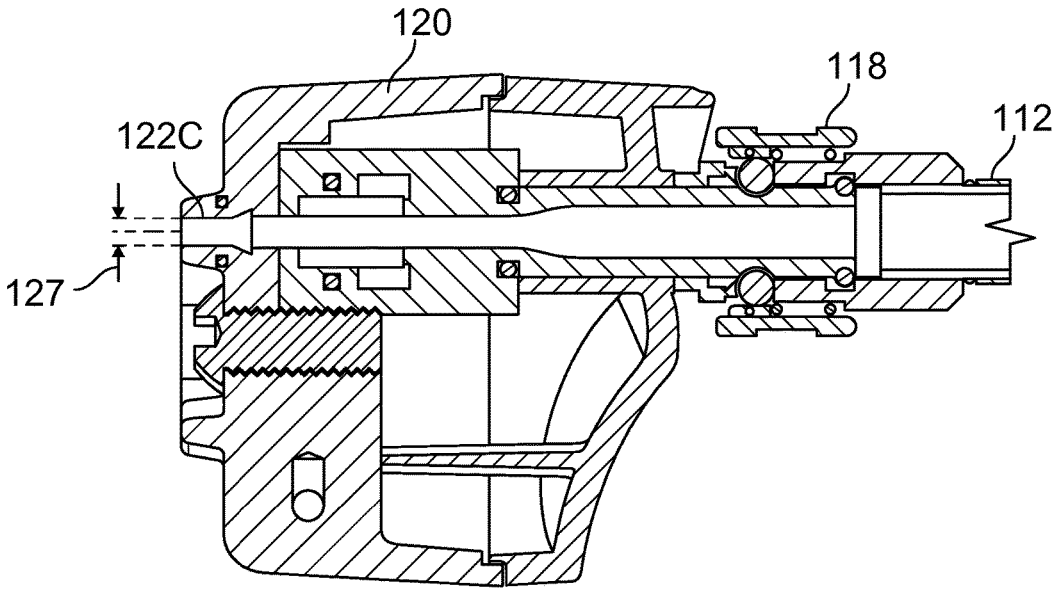
FIG. 7 illustrates another sectional view of a turret nozzle assembly for the pressure washer gun of FIG. 1.

While foaming sprays are possible with the configuration described above, spray gun 100 not limited to chemical or foaming sprays, even when chemical bottle 116 is fluidly connected to chemical injector housing 114 so as to be in communication with the fluid conduits of body 102 and spray wand 112. Instead, the type of spray emitted from spray gun 100 is dependent upon the size (e.g., orifice diameter) of the nozzle 122 used (e.g., selected via turret-style nozzle head 120 or selected from among a number of individually replaceable nozzles) and the backpressure developed within the fluid conduits of the system due to the restrictions caused by that selected nozzle. FIG. 5-FIG. 7 show exemplary nozzle of varying sizes. For example, as shown in FIG. 5, if a nozzle 122A having a relatively small orifice diameter 123 (e.g., 110 thousandths of an inch and below) is selected (e.g., on turret-style nozzle head 120), a high-pressure, low-flow spray is emitted from spray gun 100 via nozzle 122A. The restriction of this relatively small orifice causes a backpressure to build within the fluid conduits, including the chemical injector fitting 300. This backpressure prevents both secondary fluid from chemical injection inlet port 306 and air from air inlet port 308 from being drawn into the primary fluid stream traveling from inlet opening 302 to outlet opening 304. Thus, even with chemical bottle 116 fluidly coupled to chemical injector housing 114 and in communication with chemical injection inlet port 306 of fitting 300, certain nozzles (e.g., on turret-style nozzle head 120) enable the pressure washer to operate in a high-pressure mode operating mode, one without chemical additive or foaming properties.

On the other hand, as shown in FIG. 6, if a nozzle 122B having a slightly larger nozzle orifice diameter 125 (e.g., between 110 thousandths of an inch and 150 thousandths of an inch) is selected (e.g., on turret-style nozzle head 120), the backpressure developed within system is less than that described above with respect to nozzle 122A, and secondary fluid from chemical bottle 116 is drawn through chemical injection inlet port 306 and into the primary fluid flowing through fitting 300, enabling a chemical injection operating mode. However, the backpressure developed with nozzle 122B is still great enough to prevent air from being drawn into the primary fluid flow, as air inlet port 308 is located downstream from venturi section 310 and is thus more susceptible to backpressure developed due to nozzle orifice size. Accordingly, the selection of a certain nozzle (or nozzles) (e.g., via turret-style nozzle head 120) may allow the pressure washer to operate in a mode that enables somewhat high pressures with chemical additive, but without foaming properties. This mode is determined simply by the nozzle chosen and does not require any additional input from the user.

Finally, as shown in FIG. 7, if the user chooses a nozzle 122C having an even larger nozzle orifice diameter 127 (e.g., 150 thousandths of an inch or greater), the backpressure developed within the system is low enough that secondary fluid is drawn through chemical injection inlet port 306 and air is drawn through air inlet port 308 into the primary fluid flowing through fitting 300. Such a configuration allows for a foaming spray to be emitted from the selected nozzle (e.g., of turret-style nozzle head 120), and is again determined simply by the nozzle chosen (e.g., on turret-style nozzle head 120).

Figure 8:
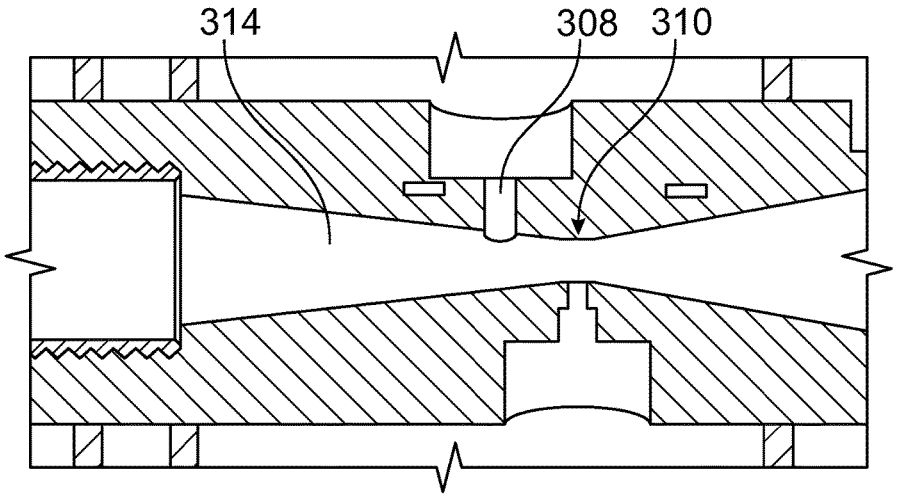
FIG. 8 illustrates a chemical injector fitting for the pressure washer gun of FIG. 1.

While the exemplary embodiment illustrated in FIG. 3 and FIG. 4 shows air inlet port 308 being located only slightly downstream of venturi throat 310, it is to be understood that air inlet port 308 may be located closer or farther downstream of venturi throat 310 than illustrated, and the system may be tuned for a particular set of nozzles such that chemical injection and foaming only occur when desired. For example, FIG. 8 illustrates a venturi section tuned to enable the various chemical/foaming/spray characteristics provided by the various nozzle settings set forth above with respect to FIG. 5-FIG. 7. The air inlet port 308 is positioned along the venturi at a point where the inside diameter of diffuser section 314 is approximately 0.15 inches, while the inside diameter of the venturi throat 310 is approximately 0.11 inches. This configuration allows for both chemical and air to be drawn (and thus foam) when a nozzle diameter greater than 0.15 inches is selected, only chemical to be drawn when a nozzle between 0.11 inches and 0.15 inches, and only fluid spray (no chemical or foam) when the nozzle diameter is less than 0.11 inches. The inside diameter of air inlet port 308, the inside diameter of the venturi throat 310 and the diameter of the nozzles available for use with spray gun 100 are selected so that "foaming" nozzles have a diameter larger than both air inlet port 308 and venturi throat 310 to draw both chemical and air into the primary fluid flow, "chemical-only" nozzles have a diameter smaller than air inlet port 308, but larger than venturi throat 310 to only draw chemical into the primary fluid flow, and "water-only" nozzles have a diameter smaller than both air inlet port 308 and venturi throat 310 so that neither chemical nor air is drawn into the primary fluid flow.

Additionally, the location of fitting 300 is illustrated in FIG. 1 and FIG. 2 as being in series with body 102 and wand 112, but could be located elsewhere in the system (e.g., nearer to the nozzle, at the pump, etc.). However, it is advantageous to have fitting 300 in the spray gun 100 itself because causes of backpressure are limited to nozzle orifice size as opposed to other external causes (e.g., a kinked hose). In some embodiments, fitting 300 and body 102 are integrally formed as a single unitary component. In some embodiments, fitting 300 and wand 112 are integrally formed as a single unitary component.

Although the present disclosure has been described with reference to example embodiments, workers skilled in the art will recognize that changes may be made in form and detail without departing from the spirit and scope of the defined subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in technology are foreseeable. The present disclosure described with reference to the example embodiments and set forth in the following definitions is manifestly intended to be as broad as possible. For example, unless specifically otherwise noted, the definitions reciting a single particular element also encompass a plurality of such particular elements.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges or geometric relationships provided. Accordingly, these terms should be interpreted as indicating that insubstantial or inconsequential modifications or alterations of the subject matter described and claimed are considered to be within the scope of the invention as recited in the appended claims.

"Fluidly coupled" locations or locations "in fluid communication" are connected such that a fluid (including air or other gas) is able to flow between locations.

What is claimed is:

1. A pressure washer spray gun, comprising:

a spray gun body configured to be fluidly coupled to a source of pressurized water;

a chemical container coupled to the spray gun body, wherein the chemical container is configured to contain liquid chemical;

a venturi including a converging section, a throat, and a diverging section, wherein the venturi is coupled to the body, and wherein the throat directly connects the converging section to the diverging section;

a chemical injection port formed in the throat and fluidly coupling the throat to the chemical container;

an air inlet port formed in the diverging section and configured to fluidly couple the diverging section to a source of air; and a plurality of nozzles, wherein each nozzle has a different orifice diameter, and wherein only one nozzle at a time can be selected to provide a fluid output from the spray gun.

2. The pressure washer spray gun of claim 1, wherein, in operation, with a first nozzle having a first orifice diameter selected, a first back pressure is created at the venturi, thereby implementing a high pressure operating mode in which pressurized water flows through the venturi and flows through the first nozzle;

wherein, in operation, with a second nozzle having a second orifice diameter greater than the first orifice diameter selected, a second back pressure less than the first back pressure is created at the venturi, thereby implementing a chemical injection operating mode in which pressurized water flows through the venturi and draws liquid chemical into the throat, resulting in a combined fluid flow exiting the diverging section and flowing through the second nozzle; and wherein, in operation, with a third nozzle having a third orifice diameter greater than the second orifice diameter selected, a third back pressure less than the second back pressure is created at the venturi, thereby implementing a foaming chemical injection mode in which pressurized water flows through the venturi and draws liquid chemical into the throat and draws air into the diverging section, resulting in a foaming combined fluid flow exiting the diverging section and flowing through the third nozzle.

3. The pressure washer spray gun of claim 1, wherein the plurality of nozzles are included in a rotatable nozzle head, wherein the nozzle head is rotatable to select the desired nozzle.

4. The pressure washer spray gun of claim 3, further comprising:

a wand attached between the rotatable nozzle head and the venturi to fluidly couple the venturi to the rotatable nozzle head.

5. The pressure washer spray gun of claim 4, wherein the venturi is formed in a fitting attached between the spray gun body and the wand.

6. The pressure washer spray gun of claim 1, wherein the plurality of nozzles comprises a plurality of individually replaceable nozzles.

7. The pressure washer spray gun of claim 1, wherein the source of air is ambient atmosphere.

8. The pressure washer spray gun of claim 1, wherein the venturi is formed in a fitting.

9. The pressure washer spray gun of claim 8, wherein the fitting is attached to the spray gun body.

10. The pressure washer spray gun of claim 1, wherein the spray gun body and the venturi are integrally formed as a single unitary component.

11. A pressure washer spray gun, comprising:

a spray gun body configured to be fluidly coupled to a source of pressurized primary fluid;

a fluid container coupled to the spray gun body, wherein the fluid container is configured to contain a secondary fluid;

a venturi including a converging section, a throat, and a diverging section, wherein the venturi is coupled to the body, and wherein the throat directly connects the converging section to the diverging section;

a chemical injection port formed in the throat and fluidly coupling the throat to the fluid container;

an air inlet port formed in the diverging section and configured to fluidly couple the diverging section to a source of air; and a plurality of nozzles, wherein each nozzle has a different orifice diameter, and wherein only one nozzle at a time can be selected to provide a fluid output from the spray gun.

12. The pressure washer spray gun of claim 11, wherein, in operation, with a first nozzle having a first orifice diameter selected, a first back pressure is created at the venturi, thereby implementing a high pressure operating mode in which pressurized primary fluid flows through the venturi and flows through the first nozzle;

wherein, in operation, with a second nozzle having a second orifice diameter greater than the first orifice diameter selected, a second back pressure less than the first back pressure is created at the venturi, thereby implementing a secondary fluid injection operating mode in which pressurized primary fluid flows through the venturi and draws secondary fluid into the throat, resulting in a combined fluid flow exiting the diverging section and flowing through the second nozzle; and wherein, in operation, with a third nozzle having a third orifice diameter greater than the second orifice diameter selected, a third back pressure less than the second back pressure is created at the venturi, thereby implementing a foaming secondary fluid injection mode in which pressurized primary fluid flows through the venturi and draws secondary fluid into the throat and draws air into the diverging section, resulting in a foaming combined fluid flow exiting the diverging section and flowing through the third nozzle.

13. The pressure washer spray gun of claim 11, wherein the plurality of nozzles are included in a rotatable nozzle head, wherein the nozzle head is rotatable to select the desired nozzle.

14. The pressure washer spray gun of claim 11, wherein the plurality of nozzles comprises a plurality of individually replaceable nozzles.

15. The pressure washer spray gun of claim 11, wherein the venturi is formed in a fitting.

16. The pressure washer spray gun of claim 15, wherein the fitting is attached to the spray gun body.

17. The pressure washer spray gun of claim 11, wherein the spray gun body and the venturi are integrally formed as a single unitary component.

18. A pressure washer spray gun, comprising:

a spray gun body including an inlet for receiving a pressurized fluid and a valve configured to be manipulated by a user to control discharge of the pressurized fluid;

a rotatable end including a plurality of nozzles, wherein the rotatable end can be rotated by a user, and wherein upon rotation, one of the plurality of nozzles is selected to discharge fluid from the pressure washer spray gun, wherein the plurality of nozzles each have a different sized effective opening;

a secondary fluid container coupled to the spray gun body;

a venturi provided between the inlet, the rotatable end, and the secondary fluid container;

an air inlet;

wherein when a first nozzle is selected, only the pressurized fluid flows through the first nozzle;

wherein when a second nozzle is selected, the pressurized fluid draws the secondary fluid into the venturi from the secondary fluid container, forming a combined fluid flow for discharge through the second nozzle; and wherein when a third nozzle is selected, the pressurized fluid draws the secondary fluid into the venturi from the secondary fluid container, forming a combined fluid flow, and at least one of the pressurized fluid and the combined fluid flow draws air into the venturi through the air inlet, forming a foaming combined fluid flow for discharge through the third nozzle.

19. The pressure washer spray gun of claim 18, wherein the venturi is formed in a fitting.

20. The pressure washer spray gun of claim 19, wherein the fitting is attached to the spray gun body.

* * * * *